US008003032B2

(12) United States Patent
Al-Sabih et al.

(10) Patent No.: US 8,003,032 B2
(45) Date of Patent: Aug. 23, 2011

(54) SYSTEM AND METHOD FOR PROCESSING MATERIAL

(76) Inventors: Adel K. Al-Sabih, Safat (KW); Hilal A. Abu Rumh, Safat (KW)

( * ) Notice: Subject to any disclaimer, the term of this patent is extended or adjusted under 35 U.S.C. 154(b) by 124 days.

(21) Appl. No.: 12/261,266

(22) Filed: Oct. 30, 2008

(65) Prior Publication Data

US 2010/0109196 A1 May 6, 2010

(51) Int. Cl.
*B28B 5/00* (2006.01)

(52) U.S. Cl. ..... 264/157; 264/294; 264/678; 425/217; 425/295; 425/305.1; 425/306; 83/39; 83/404

(58) Field of Classification Search ..... 425/217, 425/292, 295, 301, 302.1, 305.1, 306; 83/78, 83/84, 86, 90, 91, 401, 404, 39; 264/157, 264/158, 294, 678
See application file for complete search history.

(56) References Cited

U.S. PATENT DOCUMENTS

| | | | | |
|---|---|---|---|---|
| 1,627,007 A | | 5/1927 | Baker | |
| 2,950,225 A | * | 8/1960 | Losse | 162/201 |
| 3,065,514 A | | 11/1962 | Jakobsson et al. | |
| 3,350,757 A | * | 11/1967 | Bowles | 425/302.1 |
| 3,511,173 A | * | 5/1970 | Morrow | 100/7 |
| 3,734,991 A | | 5/1973 | Vrijma | |
| 3,751,544 A | | 8/1973 | Smorenburg | |
| 3,919,372 A | | 11/1975 | Vogele | |
| 4,419,065 A | | 12/1983 | Cox | |
| 4,440,702 A | * | 4/1984 | Susnjara | 425/301 |
| 4,536,145 A | | 8/1985 | Sawyer et al. | |

FOREIGN PATENT DOCUMENTS

| | | | |
|---|---|---|---|
| DE | 3431383 A | * | 2/1986 |
| DE | 43 40 785 | | 11/1993 |
| JP | 2001-113516 | | 4/2001 |
| KR | 781700 B1 | * | 12/2007 |

OTHER PUBLICATIONS

Derwent Englsih Abstract of DE 3431383, 1986.*
English machine translation of KR 781700, retrieved from KIPO May 3, 2011.*
Derwent abstract for KR 781700, 2008.*

* cited by examiner

*Primary Examiner* — Joseph S Del Sole
*Assistant Examiner* — Timothy Kennedy
(74) *Attorney, Agent, or Firm* — Bacon & Thomas, PLLC

(57) ABSTRACT

A system for processing materials includes handling and cutting stations positioned at appropriate positions along first and second conveying portions. A crust cutting station is positioned along the first conveyor portion. A crust removal station is positioned to span across the first and second conveying portions. Similarly, a stacking station is also positioned to span across the first and second conveying portions. Further, a first (vertical) cross cutting station is position along the second conveyor portion. Similarly, a second (horizontal) cross cutting station is located along the second conveyor portion. The process of using the disclosed system eliminates the need for specially designed stacking frames or trays and support rods, and improves cutting capacity and reduces processing time by only stacking the materials to be processed once, without de-stacking and restacking steps.

19 Claims, 5 Drawing Sheets

SYSTEM AND METHOD FOR PROCESSING MATERIAL

FIELD OF THE INVENTION

The present invention relates generally to the field of manufacturing and processing materials, and more particularly to a system and method of cutting and handling materials which may be used as products for building or construction. Exemplary materials for processing may include porous (foamed) or cellular lightweight concrete blocks or slabs. The exemplary system and method of cutting and handling materials is particularly suited for processing Aerated Autoclaved Concrete (AAC) blocks and slabs in a semi-plastic state (also known as green cake).

BACKGROUND

Aerated Autoclaved Concrete (AAC) blocks and slabs are produced in many different ways. The numerous methods of producing AAC blocks and slabs share the same general process, with differences between methods arising in the manner of handling and cutting the green cake. In each of the existing processes the output capacity of the manufacturing plant is greatly influenced by the capacity of the cutting machines.

The general process of producing AAC blocks and slabs may include the following steps. To begin, the cementous raw material, combined with a rising agent such as aluminum powder and water, is thoroughly mixed and poured into an open top mold.

After a sufficient period of time in which rising has occurred and the mix is sufficiently stable enough to handle (in the semi-plastic, or green cake, state), the sides of the mold are opened and the green cake is picked up by a grab crane and placed on a cutting machine on a specially designed frame positioned over cross cutting wires.

The green cake is next cross cut by oscillating cross cutting wires. Then the cake is pushed through vertical and horizontal sets of oscillating cutting wires to complete cutting the cake in three directions. The specially designed frame passes under the machine and picks up the cake at the other end, which is a very complicated and costly design.

The specially designed frame with the cut cake thereon next moves to a vacuum crane which lifts the uneven top and side crusts of the cake and releases them onto a recycling bin adjacent to the cake.

The frame is then moved to a stacking station where several frames (usually three) are stacked one over the other by a stacking crane, with manually placed steel columns, which act as spacer rods, positioned in between the stacked cakes and frames.

The set of stacked frames and cakes is then placed in an autoclave for steam curing at elevated temperature and pressure.

After curing and removal from the autoclave, the stacked frames and cakes are then de-stacked by a de-stacking crane with manual removal of the steel columns. After de-stacking, the finished product is then stacked again for palletizing.

Thus, as can be seen from the above discussion, existing methods of processing AAC blocks and slabs require substantial equipment, time, and manual labor. In particular, the above described process requires the use of specially designed frames and spacer rods to support and stack the green cake.

Further, the above described process requires the cut green cake and frames to be initially stacked for placement in the autoclave, de-stacked once removed from the autoclave, and subsequently restacked for palletizing and delivery.

Thus, there is a need for a less complex, and time and labor saving system and method for processing material that avoids the disadvantages of the type of system and method described above. The exemplary system and method of processing materials described herein provides such a less complex, and time and labor saving system and method for processing material by increasing the capacity of a cutting machine, reducing or eliminating manual labor, eliminating stacking, de-stacking, and re-stacking steps, and eliminating the need for several major components used in the process described above. Thus, the exemplary described system and method reduce equipment and operational costs, and therefore also reduce the cost of the product.

SUMMARY

A system and method for processing material is disclosed. The system eliminates the need of specially designed trays or frames and spacers. Additionally, the system eliminates several steps such as stacking, de-stacking and re-stacking. The system farther reduces or eliminates manual labor associated with placing the spacer rods and removing them between frames associated with an eliminated stacking step.

The system and method generally begins at the stage where green cake in the open top mold is ready for processing. At least first and second green cakes are utilized to begin the process. It is recognized that more than two green cakes may be utilized. The first green cake is passed through a crust cutting station and the cut crust of the first green cake is removed. It will be recognized that when more than two green cakes are utilized, the crusts will be removed from intermediately stacked green cakes as well.

Next, the first green cake is placed directly on the first cross cutting station and the second green cake is stacked on top of the first green cake. Both stacked cakes are then simultaneously cut in two directions (vertically).

The stacked green cakes are next moved to the second cross cutting station to be cut in the third direction (horizontally), which also cuts the crust of the second (top) green cake. The crust of the second green cake is then removed, and the stacked first and second green cakes are transferred to the autoclave for final curing. The stacked first and second green cakes do not need to be stacked for placement in the autoclave and do not need to be de-stacked after leaving the autoclave, and subsequently need not be re-stacked for palletizing.

The advantages of the above described system and method are numerous. For example, the introduction of two directional cross cutting stations eliminates the need of costly frames, and complicated cutting machines.

Further, the concept of directly stacking cakes without frames in between and cutting them vertically in one pass substantially increases cutting capacity. This further eliminates the need of several subsequent machines and equipment components, such as a stacking machine, a de-stacking machine, and special frames and support rods. Direct stacking of the green cakes also simplifies palletizing by eliminating the need of restacking of the finished products.

As described above, the cutting process is separated into two distinct cutting stations. The first station is for the two directional vertical cutting and the second station is for the horizontal cutting. The benefit of this separation is to free the first station after completing the vertical cutting to restart the next vertical cutting cycle while the other cakes are being cut horizontally at the second station. In other words after the initial stacked cakes are cut vertically and moved to the horizontal cutting station, vertical and horizontal cutting is done simultaneously on two sets of stacked cakes to increase cutting capacity of the system.

The numerous advantages, features and functions of the exemplary embodiment of a system and method for processing material will further become readily apparent and better understood in view of the following description and accompanying drawings. The following description is not intended to limit the scope of the system and method for processing material, but instead merely provides exemplary embodiments for ease of understanding.

Figure 1:
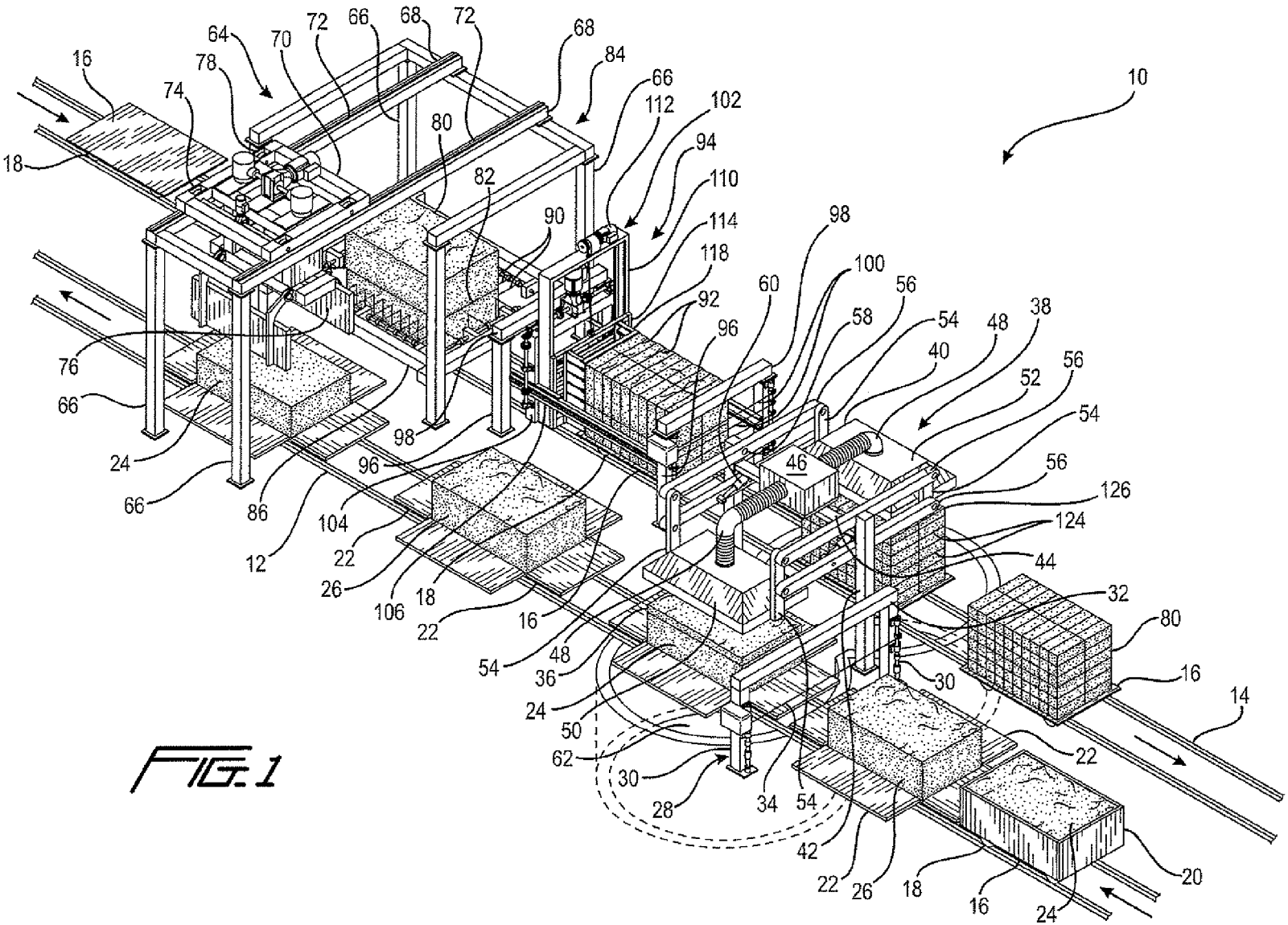
FIG. 1 is a perspective view of the system and method of processing material according to an exemplary embodiment.

It should be noted that the drawing figures are not necessarily drawn to scale, but instead are drawn to provide a better understanding of the components thereof and are not intended to be limiting in scope, but rather provide exemplary illustrations. It should further be noted that the figures illustrate an exemplary embodiment of a system and method for processing materials, and in no way limit the structures or configurations of a system and method for processing materials according to the present disclosure.

DETAILED DESCRIPTION

A. Environment and Context of the Exemplary Embodiment

Aerated Autoclaved Concrete (AAC) as well as similar types of porous light weight concrete (foam concrete), is produced in a well known and traditional manner and cured to a semi-plastic state (green cake) in an open top or other suitable mold. The exemplary embodiment disclosed herein describes a system and method for processing material, in particular of handling and cutting the green cake (semi-plastic state) in a simple and efficient way to increase the capacity of the cutting machine while eliminating numerous steps, machines and components, and manual labor necessary for many conventionally cutting and handling systems and methods.

While the following discussion describes a system and method used to process two green cakes, it will be recognized that the principles discussed herein with respect to two green cakes may be extended to process more than two green cakes.

B Detailed Description of an Exemplary Embodiment

An exemplary embodiment of a system 10 for processing material is shown generally in FIG. 1. The system may be used to process lightweight concrete materials, such as, for example, Aerated Autoclaved Concrete (AAC) blocks and slabs, porous (foamed) or cellular lightweight concrete blocks or slabs, or any other semi-plastic or plastic materials suitable for processing into blocks or slabs.

As shown in FIG. 1, the exemplary material processing system includes first and second parallel conveyor and track portions 12, 14. While the illustrated track portions 12, 14 are each composed of two parallel tracks, it will be recognized that any suitable conveying system may be utilized. For example, conveyer belts, rollers, or other appropriate conveying mechanisms may be substituted for the shown track systems 12, 14.

As will be discussed in more detail below, handling and cutting stations are positioned at appropriate positions along the track portions 12, 14. In particular, a crust cutting station 28 is positioned along the first conveyor portion 12. Additionally, a crust removal station 38 is positioned to span across the first and second conveying portions 12, 14. Similarly, a stacking station 64 is also positioned to span across the first and second conveying portions 12, 14. Further, a first (vertical) cross cutting station 84 is position along the second conveyor portion 14. Similarly, a second (horizontal) cross cutting station 94 is located along the second conveyor portion 14.

As further shown in FIG. 1, conveying platforms or carts 16 having a substantially planar supporting surface are utilized to support and transport semi-plastic block materials (green cakes, or simply cakes) along each of the first and second conveying portions 12, 14. If as shown, the first and second conveying portions 12, 14 are composed of tracks, then each of the conveying platforms or carts 16 will include wheels or rollers 18 for cooperating with the track portions 12, 14 to transport the cakes thereon. If a roller or conveyer belt system is utilized, the conveying platforms need not include wheels or rollers, but may simply be planar supporting surfaces.

Prior to utilizing the system 10 to process and cut cakes, at least first and second cakes 24, 26 are semi-cured into a semi-plastic state via the use of open top molds 20, or any suitable type of mold. The open top molds 20 include openable mold sides 22, which may be hinged to the base of the mold or completely removable therefrom. As previously mentioned, the system may be utilized to process and stack more than two cakes, as long as the lower cake strength will support the weight of the upper cakes. Additionally, the system is designed for continuous operation such that each station is actively processing cakes in a continuous manner that will be further described below.

Once the cakes 24, 26 have sufficiently hardened in the molds 20 so that the cakes 24, 26 can be handled and stacked the cakes 24, 26 within the molds 20 can be positioned in a continuous, end to end manner on the first conveying portion 12 to begin processing. It will be noted that the use of the open top molds produces an uneven surface on the top of each of the cakes 24, 26, which it is necessary to remove for stacking purposes, and also for cosmetic reasons.

Prior to beginning the processing of the cakes 24, 26, the sides 22 of the molds 20 are opened to allow access to the sides of the cakes 24, 26. Once the molds 20 are opened, the first cake 24 is transported along the first conveyor portion 12 towards the crust cutting station 28.

The crust cutting station includes two opposed vertical stays 30 positioned on either side of the first conveyor portion 12 and connected along a top portion thereof by a horizontal stay 32. An adjustable height horizontal cutting wire 34 also spans between the opposed vertical stays 30. The cutting wire is connected to rods along the stays 30 via clamps. The clamps can be loosened and tightened to allow the clamps to be vertically moved along the rods for the height adjustment.

Alternatively, the rods themselves may be vertically moved to adjust the height of the cutting wire 34. The rods are used to oscillate the cutting wire 34 in a known manner.

Once the first cake 24 has filly passed through the crust cutting station 28, the height of the cutting wire 34 is increased to allow the second cake 26 to pass therethrough without cutting the crust thereof. In this manner, one cutting step is eliminated from the process. Once the second cake 26 has fully passed through the crust cutting station 28, the height of the cutting wire 34 is decreased in preparation of the next first cake to be passed therethrough. The height adjustment of the cutting wire 34 also allows a user to adjust the amount of crust to be removed from the cakes to account for any irregularities between cakes or materials.

Once the first cake 24 passes through the crust cutting station 28, an uneven removable crust 36 remains on top of the first cake 24. The first cake 24 will then be transported to the crust removal station 38, where the uneven crust 36 is removed from the first cake 24.

Figure 4:
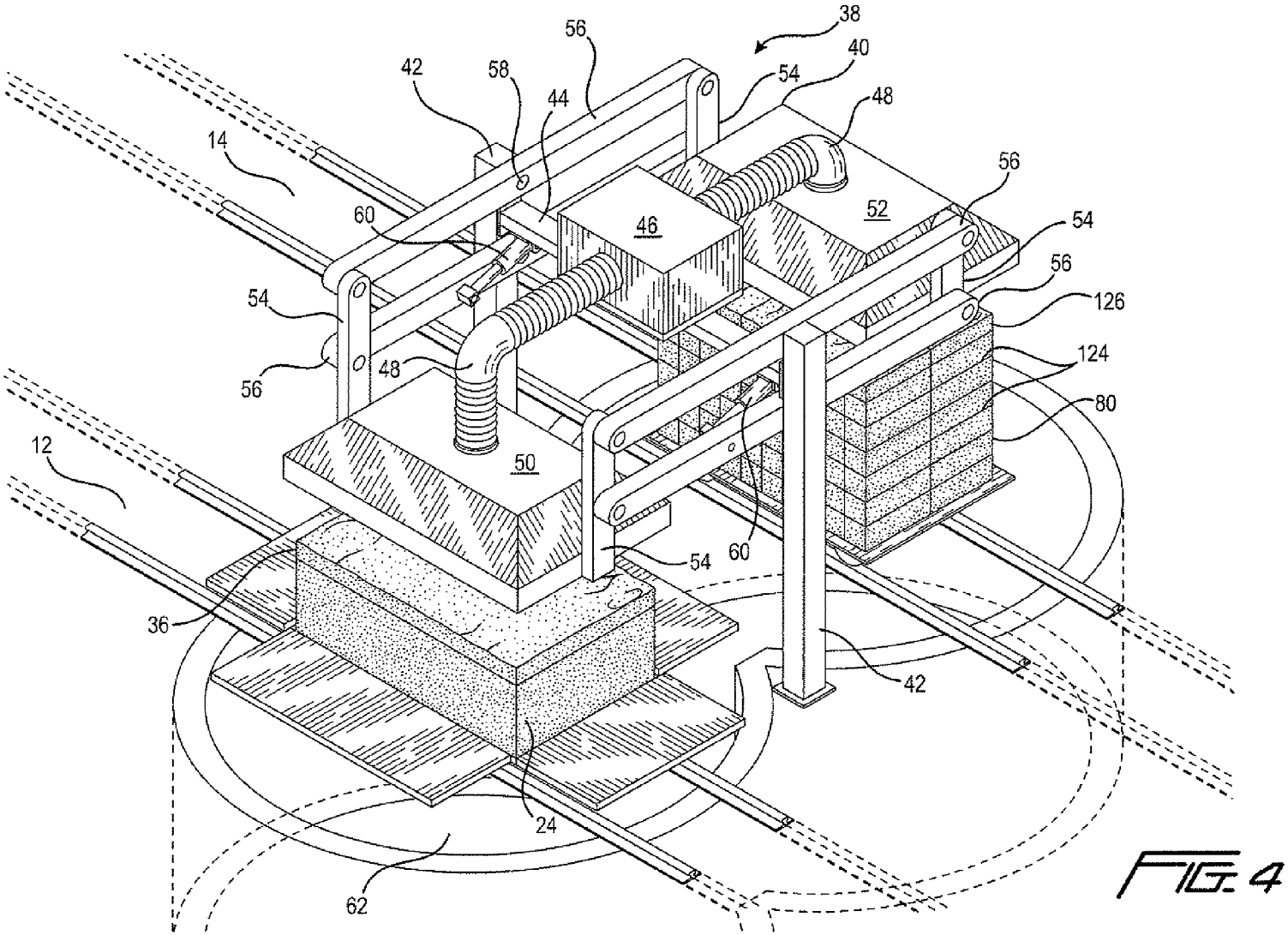
FIG. 4 is a close up perspective view of a double hood vacuum machine utilized as a crust cutting station to remove the top crust according to the exemplary embodiment of FIG. 1.

As seen in FIGS. 1 and 4, the crust removal station 38 includes a double headed vacuum hood 40 that is used to remove uneven crusts from the first cakes 24, and in a manner to be discussed below, from the second cakes 26. The double headed vacuum hood 40 is mounted to a horizontal stay 44 that spans between two vertical stays 42 that are positioned in an opposed manner between the first and second conveyor portions 12, 14. A vacuum generator 46 is positioned on the horizontal stay 44 and is connected to first and second hoods 50, 52 via flexible vacuum hosing 48.

Each of the vacuum hoods 50, 52 is mounted to respective vertical supports 54, which in turn are pivotally mounted to two sets of horizontal pivoting arms 56. The horizontal pivoting arms 56 are themselves mounted to the vertical stays 42 at pivot points 58. A lowering and lifting mechanism 60, such as hydraulic or pneumatic piston and cylinders or electric motors are provided to alternately raise and lower the first and second hoods 50, 52 via the pivot arms 56, in a manner that will be recognized to a skilled artisan.

Once the first cake 24 with the cut crust 36 is positioned below the first hood 50, the first hood 50 is lowered so that the crust 36 may be removed from the first cake 24 via the suction created by the vacuum within the hood 50. When the crust 36 is engaged with the hood 50 via the negative pressure, the hood 50 is raised and the first cake 24 is transported along the first conveyor portion 12 to a standby position.

When the first cake 24 has cleared the crust removal station 38, the vacuum within the first hood 50 is released, so that the crust 36 will disengage therefrom. A single or two recycling bins or tanks 62 are positioned below the first and second conveyor portions 12, 14 to receive the removed crust 36, which is dropped into the tank 62 when the vacuum within the hood 50 is released.

Once the crust 36 has been removed from the first cake 24, a relatively smooth and substantially planar surface remains on the top of the first cake 24 to provide a suitable supporting surface for the stacking thereon of a second cake 26, as will be further described below.

Figure 2:
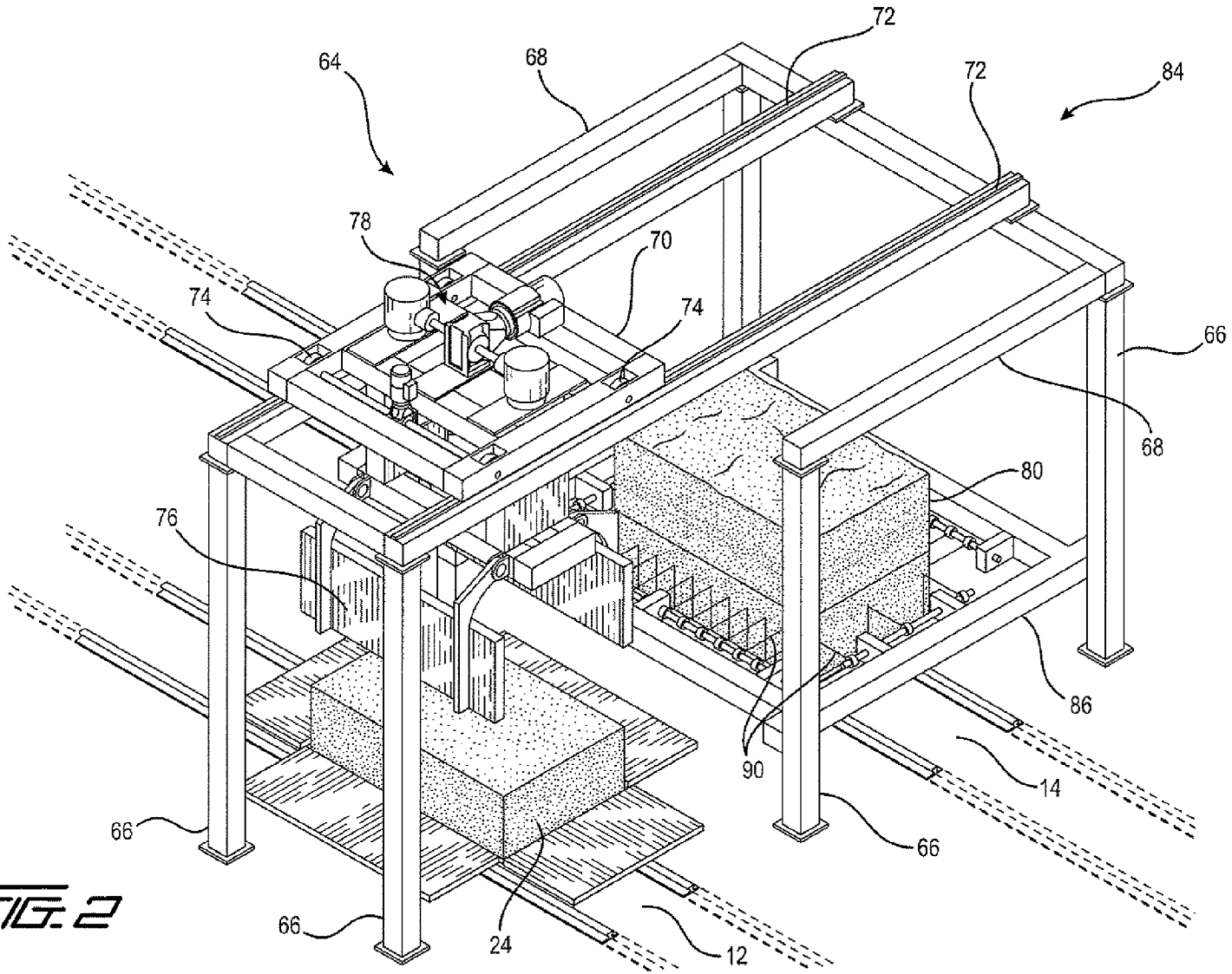
FIG. 2 is a close-up perspective view of the grab crane and the first cutting station according to the exemplary embodiment of FIG. 1.

As illustrated in FIGS. 1 and 2, the first cake is transported to the stacking station 64 following the crust removal from the first cake 24. The stacking station 64 spans across both the first and second conveyor portions 12, 14, and is utilized to transfer the first and second cakes 24, 26 from the first conveying portion 12 to the second conveying portion 14.

The stacking station 64 includes vertical stays 66 positioned on either side of, and between the first and second conveyor portions 12, 14. Horizontal stays 68 span between the vertical stays 66 to provide support for a grab crane 70. The grab crane 70 is supported on wheels or rollers 74 along translation tracks 72 that are positioned on top of one set of horizontal stays 68.

The grab crane 70 includes a grabbing and release mechanism 76, as well as lifting and translating mechanisms 78, which all may be driven in a known manner by hydraulics, pneumatics, and/or electric motors. A standard grab crane 70, as will be recognized by a skilled artisan, may be utilized, and further discussion of the specifics the grab crane 70 are not provided.

Once the first cake 24 reaches the stacking station 64, the grab crane 70 is lowered and clamped around the cake 24 to lift the cake 24 from the conveying platform 16 on the first conveyor portion 12. Once the first cake 24 has been lifted by the grab crane 70, the grab crane 70 translates across to the second conveyor portion 14.

A first (vertical) cross cutting station 84 is positioned at the second conveying portion 14 directly across from the first conveying portion 12, and within the stacking station 64. A conveying platform 16 is located and locked from moving at the first cutting station 84 to receive the first cake 24 thereon. The conveying platform 16 is a suitable platform for use with an autoclave (such as an autoclave cart), so that the cut green cakes do not need to be removed from the conveying platform 16 in order to be processed within the autoclave (not illustrated).

The first cutting station 84 includes a cutting frame 86 that is mounted to the vertical stays 66 in a known manner to be vertically raised from a lower (first) position to an upper (second) position, and lowered from the upper position to the lower position. Two sets of oscillating cutting wires 90 span between each edge of the cutting frame 86 in a substantially orthogonal manner. The cutting wires 90 are oscillated in a known manner. Further, the cutting wires 90 can be adjustable, as previously discussed, in order to adjust the cutting width therebetween or to accommodate different sized cakes.

Prior to the transfer of the first cake 24 from the first conveyor portion 12 to the first cutting station 84, the cutting frame 86 is positioned around the conveyor platform 16 such that the cutting wires 90 rest upon the conveyor platform 16 or are positioned directly adjacent to the conveyor platform 16. In this manner, when the first cake 24 is transferred to the cutting station 86 and released from the grab crane 70, the cake 24 is placed directly on top of the cutting wires 90. There is no need for specially designed frames or trays to support the cake 24 for cutting.

Once the first cake 24 has been transferred to the first cutting station 84, and the stacking station 64 is empty at the first conveyor portion 12, the second cake 26 is moved along the first conveyor portion 12 to the stacking station. The grab crane 70 also translates back to the first conveyor portion 12 from the first cutting station 84 on the second conveyor portion 14.

While the second cake 26 is being transported to the stacking station 64 and the grab crane 70 is translated to the first conveyor portion 12, the cutting frame 86, and hence the cutting wires 90, are vertically raised. Lifting the cutting frame 86 and the cutting wires 90 begins the process of creating vertical cuts 92 in the first cake 24. While the first cake 24 is being vertically cut, the second cake 26 is lifted by the grab crane 70, translated from the first conveyor portion 12 to the second conveyor portion 14, and lowered directly on top of the first cake 24 without the need for any special tray, frame, or supporting rods to be positioned between them.

With the stacked cakes 80 positioned in the first cutting station 84, the cutting frame 86 continues to rise in one pass to create continuous vertical cuts 92 in the stacked cakes 80.

While the stacked cakes 80 are being cut vertically, the grab crane 70 translates back to the first conveyor portion 12, and an additional first cake 24 is transferred to the stacking station 64 so that the process may be repeated in a continuous manner. In alternate configurations, where more than two cakes are stacked and processed, the additional cakes, instead of another first cake, will be transported to the stacking station 64, lifted and translated and added to the top of the stack 80 of cakes for cutting.

Once the cutting frame 86 and the cutting wires 90 have passed completely through the stacked cakes 80, the cutting frame is momentarily maintained in the uppermost position while the vertically cut stacked cakes 80 are rapidly transferred to the second (horizontal) cutting station 94. Once the stacked cakes 80 have been transferred to the second cutting station 94, the cutting frame 86 is lowered around a conveying platform 16 that is moved into position in the first cutting station 84, and the process of stacking a first cake 24 thereon begins again. With this arrangement, since multiple stacks of cakes are being simultaneously processed, the capacity of the cutting machines is increased, and thus, the output of the system is increased.

Figure 3:
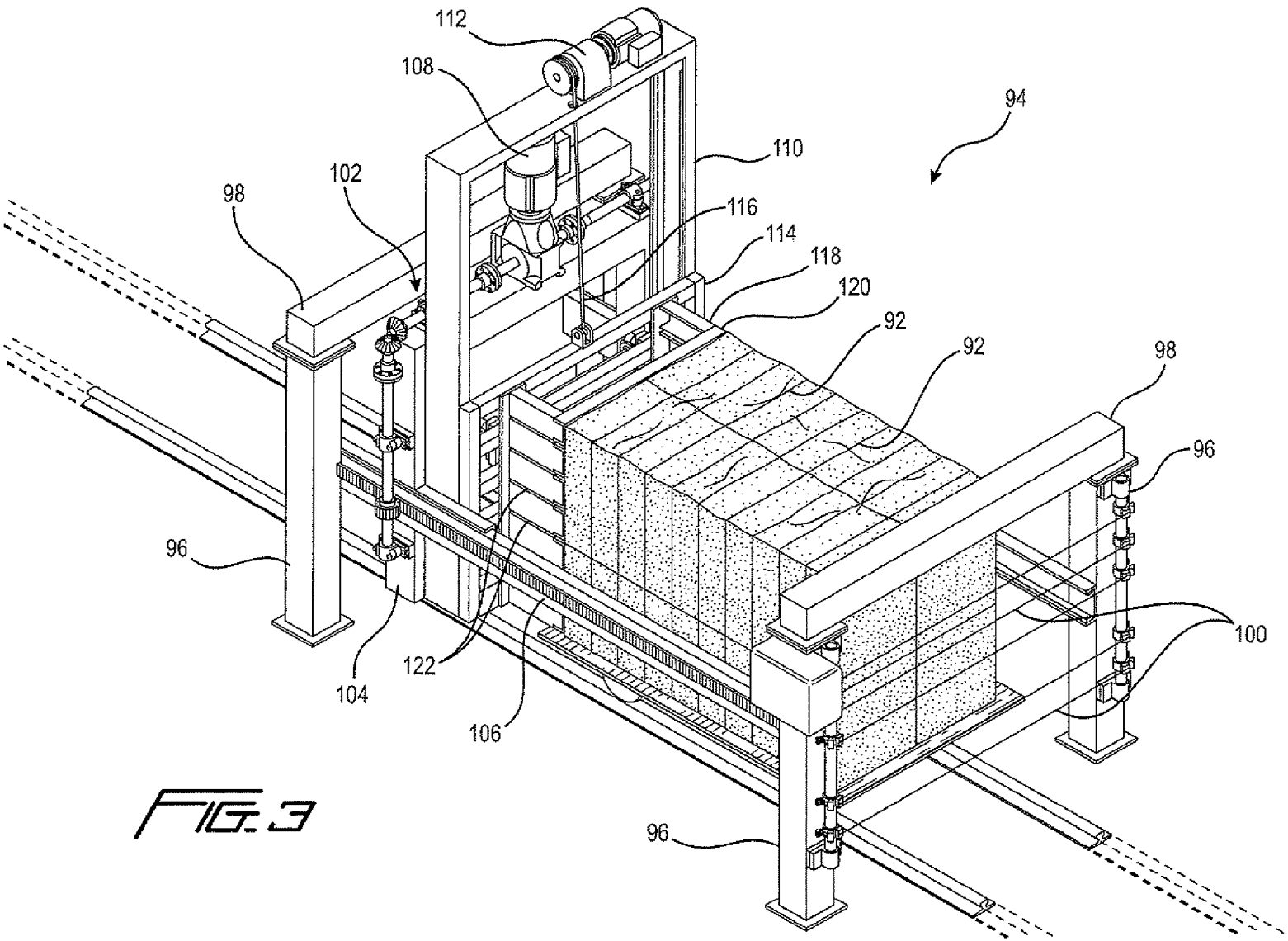
FIG. 3 is a close-up perspective view of a second cutting station, including a pusher and drive mechanism, according to the exemplary embodiment of FIG. 1.

The second cutting station 94 is shown in FIGS. 1 and 3. Similarly to other stations, the second cutting station 94 includes vertical stays 96 positioned on either side of the second conveyor portion 14 with horizontal stays 98 spanning therebetween along the second conveyor portion 14. Adjustable height oscillating cutting wires 100, of a type previously described, span across the second conveyor portion 14 between the downstream vertical stays 96, and are adjusted and oscillated as previously described. The adjustability of the cutting wires 100 allows different sized calves to be processed, as well as allowing for different sized final products.

The second cutting station 94 includes a pusher/drive mechanism 102 that is utilized to advance the stacked cakes 80 through the second cutting station 94 to cause the cutting wires 100 to pass lengthwise through the stacked cakes 80. The pusher/drive mechanism 102 includes a drive frame 104 that is mounted for rack and pinion advancement along horizontally extending racks 106 that extend between the vertical stays 96 along the second conveyor portion 14. A drive motor 108 is mounted to the top of the drive frame 104 for driving pinions along the racks 106 in a recognized manner. While a rack and pinion drive mechanism is described, any suitable drive mechanism may be used, for example a hydraulic or pneumatic piston drive mechanism, or a cable drawn drive mechanism.

The pusher/drive mechanism 102 further includes a pusher 118 that engages the stacked cakes 80 in a manner to be discussed below to advance the stacked cakes 80 through the second cutting station 94. The pusher 118 includes a substantially planar, vertically oriented pushing surface 120 to engage the stacked cakes 80. In order to allow the stacked cakes 80 to pass into the second cutting station 94 from the first cutting station 84, the pusher 118 must be moved.

A gate frame 110 attached to the drive frame 104 is provided to move the pusher 118 to allow the stacked cakes 80 to pass into the second cutting station 94 from the first cutting station 84. The gate frame 110 has a lift motor 112 with a pulley and one end of a lift cable 116 attached thereto. It will be recognized that any suitable motor may be used, such as hydraulic or pneumatic pistons, or electric motors.

The other end of the lift cable 116 is connected to the top of a lift gate 114, which has the pusher 118 mounted thereon. The lift gate 114 is vertically lifted and lowered along the gate frame 110 via the lift cable 116 between a lower (first) position and an upper (second) position. In this manner, the pusher 118 is lifted above the stacked cakes 80 when they are transferred to the second cutting station 94 from the first cutting station 84. Once the stacked cakes 80 have passed the lift gate 114 and pusher 118, the lift gate 114 and pusher 118 are lowered into position upstream of the stacked cakes 80.

When the lift gate 114 and pusher 118 are lowered into position, the drive mechanism 102 is engaged to cause the pushing surface 120 to contact the stacked cakes 80 in order to transport the stacked cakes 80 through the second cutting station 94 so that the horizontal cutting wires 100 can create horizontal cut lines 124 in the stacked cakes 80. The uppermost cutting wire 100 also cuts the crust 126 from the second cake 26 for removal as will be discussed below. A further horizontal delineation 82 is created at the interface between the stacked first and second cakes 24, 26.

Wire slots 122 are defined in the pushing surface 120 and along the width of the pusher 118 to receive the horizontal cutting wires 100 therein so that the cutting wires 100 can pass completely through the stacked cakes 80.

As the stacked cakes 80 are transported through the second cutting station 94, the stacked cakes 80 make their way to the crust removal station 38. At the crust removal station 38, the crust 126 of the second cake 26 is removed via a vacuum in the second hood 52 in the same manner as previously discussed Once the stacked cakes 80 are further advanced past the crust removal station 38, the crust 126 of the second cake 26 is dropped into the recycling tank 62 via the release of the vacuum in the second hood 52.

Once the cut and stacked cakes 80 have passed beyond the crust removal station 38, they are further advanced to an autoclave (not shown) for final curing, for example by steam curing at elevated temperature and pressure. After final curing the final product blocks are already stacked and ready for simple palletizing without the need to be de-stacked and restacked to remove complex frames, trays, and support rods.

As can be seen, once begun, the process can be continuously run to process multiple stacks of cakes simultaneously in order to increase the capacity of the system. Further, the system does not require specially designed frames or trays and support rods that would require de-stacking and re-stacking of the cakes multiple times during processing.

Figure 5:
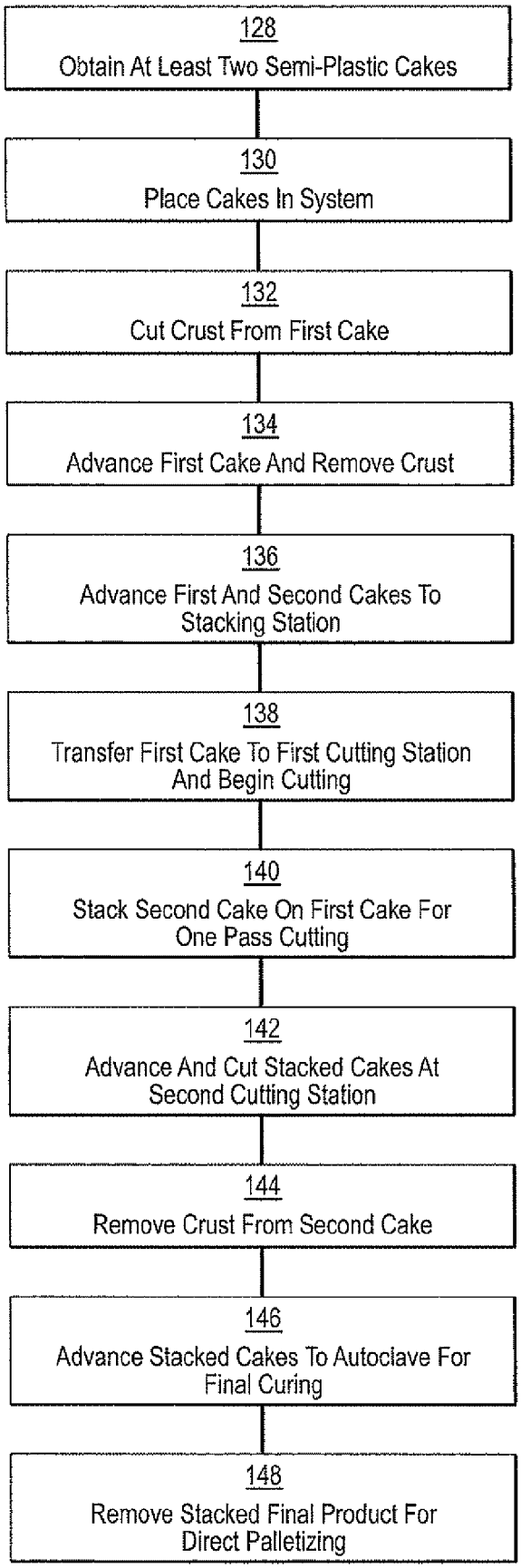
FIG. 5 is a flowchart detailing a method of processing material utilizing the system according to the exemplary embodiment of FIG. 1.

A brief synopsis of the process is shown in FIG. 5, as analyzed from an upstream side (prior to the crust cutting station) towards a downstream side (after the crust removal station positioned at the second conveying portion).

As a first step 128, at least first and second semi-plastic cakes 24, 26 are obtained in any suitable manner, such as from open top molds 20. The cakes are next placed in the system 130 at the upstream side to begin processing. If the cakes are retained in molds, the molds are opened so that the cakes can be processed.

The first cake 24 is advanced 132 to the crust cutting station 28, and the crust 36 is cut from the top of the first cake 24 to provide a substantially planar supporting surface for the second cake 26.

The first cake is advanced 134 to the crust removal station 38, where the crust 36 is removed from the first cake 24.

Both the first and second cakes 24, 26 are advanced 136 to the stacking station 64. The first cake reaches the stacking station 64 first and is transferred 138 to the first cutting station 84. Cutting of the first cake 24 begins and the second cake 26 is transferred 140 from the stacking station 64 to the first cutting station 84 and placed directly on top of the first cake 24 for one pass cutting, without the need for specially designed stacking frames or trays and support rods.

Next, the stacked cakes 80 are advanced 142 to the second cutting station for cutting the stacked cakes in one pass in a different direction.

The stacked cakes 80 are next advanced to the second portion of the crust removal station 38, and the crust 126 of the second cake 26 is removed 144.

The stacked cakes 80 are next advanced 146 directly to an autoclave for final curing, without the need to de-stack or restack the cakes. Once the stacked cakes 80 are finally cured, the final product is removed 148 from the autoclave for direct palletizing, without de-stacking or restacking, for transport and delivery to vendors, distributors, and/or job sites.

Thus, as can be seen from the above described system and process, a less complex system that eliminates certain machines and components of conventional systems, reduces or eliminates manual labor, and improves cutting capacity and reduces processing time by only stacking the cakes once, thus eliminating certain de-stacking and restacking steps, is therefore provided.

C. Conclusion

The disclosed embodiment of a system and method for processing materials provides a process that is less complex, and less time and labor intensive than traditional processes used to handle and cut blocks and slabs of materials.

It is understood that the size of the system and the components thereof can be adjusted so that different sized cakes of materials and final products may benefit from the present design. It will be further recognized that the numerous vertical and horizontal stays disclosed herein may be height and length adjustable in order to accommodate different sizes of blocks and slabs of green cake. It is also understood that any desired number of cutting wires can be provided in each of the vertical and horizontal cutting stations in order to create different sized final products.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein. For example, it will be recognized that the order of the steps in the exemplary process disclosed herein may be altered or substituted.

The skilled artisan will recognize the interchangeability of various features. In addition to the variations described herein, other known equivalents for each feature can be mixed and matched by one of ordinary skill in this art to construct a system and method for processing materials in accordance with principles of the present invention.

Although this invention has been disclosed in the context of certain exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

We claim:

1. A system for processing material comprising:

first and second parallel conveying portions;

a crust cutting station positioned along the first conveying portion;

a crust removal station spanning across the first and second conveying portions;

a stacking station spanning the first and second conveying portions configured to directly stack first and second cakes of materials;

a first cutting station positioned along the second conveying portion configured to cut the stacked first and second cakes of materials; and a second cutting station positioned along the second conveying portion configured to cut the stacked first and second cakes of materials.

2. The system for processing material according to claim 1 further comprising:

a recycling tank positioned below the crust removal station.

3. The system for processing material according to claim 1 further comprising:

a first set of conveying platforms arranged along the first conveying portion; and a second set of conveying platforms arranged along the second conveying portion.

4. The system for processing material according to claim 3, wherein the first cutting station includes first and second sets of cutting wires oriented in an orthogonal manner and mounted to a cutting frame; and the cutting frame is vertically movable from a first position to a second position;

wherein when the cutting frame is in the first position, the cutting wires are positioned on or directly adjacent to one of the conveying platforms of the second set.

5. The system for processing material according to claim 1, wherein the first cutting station includes first and second sets of cutting wires oriented in an orthogonal manner and mounted to a cutting frame; and the cutting frame is vertically movable between a first position and a second position.

6. The system for processing material according to claim 1, wherein the second cutting station includes:

a drive frame and a gate frame connected thereto;

the gate frame includes a lift frame having a pusher connected thereto; and cutting wires positioned between vertical stays downstream from the drive and gate frames.

7. The system for processing material according to claim 6, wherein the pusher includes a pushing surface having slots therein corresponding to the cutting wires of the second cutting station.

8. The system for processing material according to claim 6, wherein the lift frame is arranged to lift and lower the pusher between a first position and a second position.

9. The system for processing material according to claim 1, wherein the stacking station includes a translatable grab crane configured to lift, transfer, and lower materials to be processed.

10. A method of processing material comprising the steps of providing first and second parallel conveying portions;

providing at least first and second cakes of material;

positioning the first and second cakes of material sequentially on the first conveying portion;

providing a crust cutting station positioned along the first conveying portion;

advancing the first cake to the crust cutting station and cutting a crust therefrom;

providing a crust removal station spanning across the first and second conveying portions;

advancing the first cake to the crust removing station and removing the crust therefrom;

providing a stacking station spanning the first and second conveying portions;

advancing the first and second cakes of material sequentially to the stacking station;

providing a first cutting station positioned along the second conveying portion;

transferring the first cake to the first cutting station;

transferring the second cake to the first cutting station by stacking the second cake directly on top of the first cake;

performing a first cutting of the first and second cakes;

providing a second cutting station positioned along the second conveying portion;

advancing the first and second cakes to the second cutting station; and performing a second cutting of the first and second cakes.

11. The method of processing material according to claim 10, further comprising the steps of:

advancing the first and second cut cakes to the crust removal station; and removing a crust of the second cake.

12. The method of processing material according to claim 11, further comprising the steps of:

advancing the first and second cut cakes to an autoclave;

curing the first and second cakes; and removing the first and second cakes from the autoclave for direct palletizing.

13. The method of processing material according to claim 10, wherein the step of performing a first cutting of the first and second cakes further comprises the steps of:

beginning cutting of the first cake prior to stacking the second cake directly on top of the first cake; and continuing the cutting of the first cake and the second cake in one pass after stacking the second cake directly on top of the first cake.

14. The method of processing material according to claim 13, wherein the steps of advancing the first and second cakes to the second cutting station and performing a second cutting of the first and second cakes further comprise the steps of:

lifting a lift gate of the second cutting station;

passing the stacked first and second cakes past the lift gate into the second cutting station;

lowering the lift gate to engage a pusher with the stacked first and second cakes; and advancing the pusher to advance the stacked first and second cakes through the second cutting station.

15. The method of processing material according to claim 10 wherein the step of performing a first cutting of the first and second blocks further comprises the step of:

vertically cutting the first and second blocks with first and second sets of orthogonally oriented cutting wires.

16. The method of processing material according to claim 10 wherein the step of performing a second cutting of the first and second blocks further comprises the step of:

horizontally cutting the first and second blocks with horizontally arranged cutting wires.

17. A system for processing material comprising:

first and second parallel conveying portions;

a crust cutting station positioned along the first conveying portion;

a crust removal station spanning across the first and second conveying portions;

a stacking station configured to directly stack first and second cakes of materials spanning the first and second conveying portions and including a translatable grab crane configured to lift, transfer, and lower materials to be processed;

a first cutting station configured to cut the stacked first and second cakes of materials positioned along the second conveying portion station including first and second sets of cutting wires oriented in an orthogonal manner and mounted to a cutting frame, which is vertically movable between a first position and a second position; and a second cutting station configured to cut the stacked first and second cakes of materials positioned along the second conveying portion including a drive frame and a gate frame connected thereto, the gate frame includes a lift frame having a pusher connected thereto, and cutting wires are positioned between vertical stays downstream from the drive and gate frames.

18. A system for processing material according to claim 17, wherein the pusher includes a pushing surface having slots therein corresponding to the cutting wires of the second cutting station and the lift frame is arranged to lift and lower the pusher between a first position and a second position.

19. A system for processing material according to claim 17 further comprising:

a recycling tank positioned below the crust removal station;

a first set of conveying platforms arranged along the first conveying portion; and a second set of conveying platforms arranged along the second conveying portion.

* * * * *